US010249285B2

(12) United States Patent
Iida

(10) Patent No.: US 10,249,285 B2
(45) Date of Patent: Apr. 2, 2019

(54) ACOUSTIC CONVERSION DEVICE FOR ACTIVE NOISE CONTROL

(71) Applicants: PIONEER CORPORATION, Tokyo (JP); Tohoku Pioneer Corporation, Yamagata (JP)

(72) Inventor: Junichi Iida, Yamagata (JP)

(73) Assignees: PIONEER CORPORATION, Tokyo (JP); TOHOKU PIONEER CORPORATION, Yamagata (JP)

( * ) Notice: Subject to any disclaimer, the term of this patent is extended or adjusted under 35 U.S.C. 154(b) by 0 days.

(21) Appl. No.: 15/920,736

(22) Filed: Mar. 14, 2018

(65) Prior Publication Data

US 2018/0204559 A1 Jul. 19, 2018

Related U.S. Application Data

(62) Division of application No. 15/128,547, filed as application No. PCT/JP2014/058501 on Mar. 26, 2014, now Pat. No. 9,947,310.

(51) Int. Cl.

| | |
|---|---|
| ***G10K 11/178*** | (2006.01) |
| ***H04R 1/02*** | (2006.01) |
| ***H04R 5/02*** | (2006.01) |

(52) U.S. Cl.

CPC ..... *G10K 11/178* (2013.01); *H04R 1/025* (2013.01); *G10K 2210/1282* (2013.01); *G10K 2210/3212* (2013.01); *G10K 2210/3214* (2013.01); *G10K 2210/3229* (2013.01); *H04R 1/028* (2013.01); *H04R 5/023* (2013.01); *H04R 2499/13* (2013.01)

(58) Field of Classification Search

CPC ..... G10K 11/178; G10K 2210/1282; G10K 2210/3214; G10K 2210/3229; H04R 1/025; H04R 2499/13; H04R 5/023; H04R 2499/133

See application file for complete search history.

(56) References Cited

U.S. PATENT DOCUMENTS

| | | | |
|---|---|---|---|
| 3,882,962 | A | 5/1975 | Ripple |
| 6,801,635 | B1 | 10/2004 | Minami |

(Continued)

FOREIGN PATENT DOCUMENTS

| | | |
|---|---|---|
| JP | 04-281125 | 10/1992 |
| JP | 09-247777 | 9/1997 |

(Continued)

OTHER PUBLICATIONS

International Search Report, PCT/JP2014/058501, dated May 27, 2014.

(Continued)

*Primary Examiner* — Sonia L Gay
(74) *Attorney, Agent, or Firm* — Young & Thompson

(57) ABSTRACT

An acoustic conversion device for an active noise control is provided. The acoustic conversion device can effectively suppress or remove noise by controlling variation in a lowest resonance frequency. A volume of a closed space is smaller than an equivalent compliance air volume of a speaker unit. Therefore, motion of a vibration plate, an edge and a damper is suppressed, it is possible to restrain the edge and the damper from being deteriorated with time, variation in lowest resonance frequency can be suppressed, phase of emitted sound can be less prone to be deviated from opposite phase of noise, and it is possible to effectively suppress or remove noise.

8 Claims, 4 Drawing Sheets

(56) References Cited

U.S. PATENT DOCUMENTS

| | | | |
|---|---|---|---|
| 2005/0129266 | A1 | 6/2005 | Kobayashi |
| 2007/0076912 | A1 | 4/2007 | Griffiths |
| 2008/0101645 | A1 | 5/2008 | Rosen |

FOREIGN PATENT DOCUMENTS

| | | |
|---|---|---|
| JP | 2002-271882 | 9/2002 |
| JP | 2002-351488 | 12/2002 |
| JP | 2003-037894 | 2/2003 |

OTHER PUBLICATIONS

JLAudio, CES 2012: New Stealth box Subwoofer Systems for JL Audio, downloaded from JL Audio website, Jan. 9, 2012.
Hollowboy, Sealed Speaker Design, downloaded from Everything2.com, Apr. 9, 2002.

ACOUSTIC CONVERSION DEVICE FOR ACTIVE NOISE CONTROL

TECHNICAL FIELD

The present invention relates to an acoustic conversion device for an active noise control having a speaker unit for emitting sound into a room space of a vehicle.

BACKGROUND ART

There is conventionally proposed a noise canceling device (acoustic conversion device for active noise control) for suppressing or removing noise around a vehicle (e.g., refer to Patent Literature 1). According to the conventional noise canceling device described in Patent Literature 1, a relation between noise such as engine sound, wind noise and tire friction sound, and a vehicle state such as vehicle type, speed and acceleration is previously stored, and sound having opposite phase to the noise is emitted into a room space of the vehicle in accordance with the vehicle's state, thereby suppressing or removing the noise.

CITATION LIST

Patent Literature

Patent Literature 1: JP 2002-351488 A

SUMMARY OF INVENTION

Technical Problem

According to the conventional noise canceling device described in Patent Literature 1, however, although it is necessary to control the phase such that emitted sound and noise have opposite phases, since a phase of the speaker unit abruptly changes before and after the lowest resonance frequency, if the lowest resonance frequency is varied due to deterioration with time of the speaker unit, there is a possibility that sound which is deviated from the opposite phase of the noise in the vicinity of the lowest resonance frequency is emitted. If sound which is deviated from the phase is emitted, the sound cannot negate the noise, or strengthens the noise, and a suppressing effect of noise is lowered.

It is an object of the present invention to provide an acoustic conversion device for an active noise control capable of suppressing variation in lowest resonance frequency and capable of effectively suppressing or removing noise.

Solution to Problem

In order to solve the problem and achieve the object, an acoustic conversion device for an active noise control of the present invention includes: a speaker unit for emitting sound into a room space of a vehicle; and a closed space-forming unit for forming a closed space. The speaker unit is mounted to the closed space-forming unit. The speaker unit includes a vibration plate and an edge which supports the vibration plate. One surface of the vibration plate emits sound to the room space, and the other surface thereof emits sound to the closed space. A volume of the closed space is smaller than an equivalent compliance air volume of the speaker unit.

DESCRIPTION OF EMBODIMENT

Figure 1:
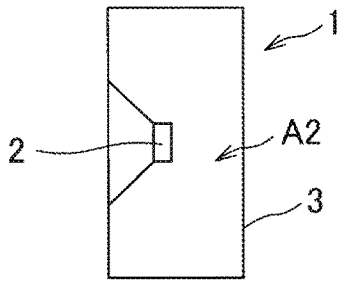
FIG. 1 is a schematic diagram illustrating an acoustic conversion device for an active noise control according to Example 1 of an embodiment of the present invention.

An embodiment of the present invention will be described below. An acoustic conversion device for an active noise control according to an embodiment of the present invention includes: a speaker unit for emitting sound into a room space of a vehicle; and closed space-forming unit for forming a closed space, the speaker unit being mounted to the closed space-forming unit, wherein the speaker unit includes a vibration plate and an edge which supports the vibration plate, one of surfaces of the vibration plate emits sound to the room space, and the other surface emits sound to the closed space, and a volume of the closed space is smaller than an equivalent compliance air volume of the speaker unit.

A volume of the closed space is smaller than the equivalent compliance air volume. Therefore, in the acoustic conversion device for the active noise control having the closed space-forming unit, motion of the vibration plate and its peripheral member (e.g., edge and damper) is suppressed, and it is possible to suppress deterioration with time of the speaker unit. Therefore, it is possible to suppress the variation in lowest resonance frequency, phase of emitted sound can be less prone to be deviated from the opposite phase of noise, and it is possible to effectively suppress or remove the noise.

It is preferable that the volume of the closed space is 40% or more and 80% or less of the equivalent compliance air volume. If the volume of the closed space is greater than 80% of the equivalent compliance air volume, the suppressing effect of deterioration with time of the speaker unit is lowered. If the volume of the closed space is smaller than 40% of the equivalent compliance air volume, motion of the vibration plate and edge is excessively suppressed, and sound pressure especially in a low frequency region becomes small. Therefore, by setting the volume of the closed space 40% or more and 80% or less of the equivalent compliance air volume, it is possible to more effectively suppress the deterioration with time of the vibration plate and the peripheral members as described above, and sound pressure in the low frequency sound can be secured.

It is preferable that lowest resonance frequency in a state where the speaker unit and the closed space-forming unit are assembled together is 30 Hz or more and 50 Hz or less. According to this, it is possible to effectively suppress or remove noise (e.g., 40 Hz to 200 Hz) included in engine sound for example. If the lowest resonance frequency is greater than 50 Hz, it becomes difficult to suppress noise such that acoustic wave of opposite phase is appropriately emitted to noise of low sound (e.g., 40 Hz). If the lowest resonance frequency is smaller than 30 Hz, compliance of the speaker unit (easiness of motion of vibration plate) adversely becomes large, and the peripheral member of the vibration plate is prone to be deteriorated.

It is preferable that an effective vibration diameter of the vibration plate is 10 cm or more and 14 cm or less, and the volume of the closed space is 5 liters or more and 7 liters or less. According to this, it is possible to reduce a size of the entire acoustic conversion device for the active noise control, and it becomes easy to place the acoustic conversion device in the vicinity of a passenger utilizing an appropriate space of the vehicle. If the effective vibration diameter is too large or the volume of the closed space is too large, it becomes difficult to place the acoustic conversion device for the active noise control in the vicinity of a passenger. If the effective vibration diameter is too small or the volume of the closed space is too small, sound pressure in low sound of this acoustic conversion device for the active noise control adversely becomes small. The effective vibration diameter means a diameter of a portion of the speaker unit which vibrates when sound is emitted. Typically, ½ of a difference between inner and outer diameters of the edge is added to a radius of the vibration plate.

It is preferable that the closed space-forming unit is provided below a seat of the vehicle. According to this, the room space of the vehicle can be utilized effectively.

It is preferable that the closed space-forming unit is provided in a dashboard of the vehicle. According to this, the room space of the vehicle can be utilized effectively.

It is preferable that the closed space-forming unit is provided under a floor of the vehicle. According to this, a space under a floor of the vehicle can be utilized effectively.

It is preferable that the closed space-forming unit includes first member forming a first closed space in which the speaker unit is accommodated, and a second member forming a second closed space which is in communication with the first closed space, and sound emitted from the speaker unit to the first closed space is emitted to the second closed space. According to this, even if an installation space in the vicinity of a passenger is small, if the first member is placed in the vicinity of the passenger and the second member is placed at an appropriate position in the vehicle, noise which the passenger feels can be suppressed or removed, and it is possible to secure a volume of the closed space.

It is preferable that the closed space-forming unit includes first member forming a first closed space in which the speaker unit is accommodated, and a second member forming a second closed space which is in communication with the first closed space, and the volume of the closed space is equal to a total of a volume of the first closed space and a volume of the second closed space. According to this, as described above, noise which the passenger feels can be suppressed or removed, it is possible to secure a volume of the closed space, and it is possible to restrain the vibration plate and the peripheral member from being deteriorated.

EXAMPLES

Examples of the present invention will be described below specifically. In Example 2, the same reference signs are allocated to the same constituent members as those of Example 1 and to constituent members having the same functions as those of Example 1, and explanation thereof will be omitted.

Example 1

Figure 2:
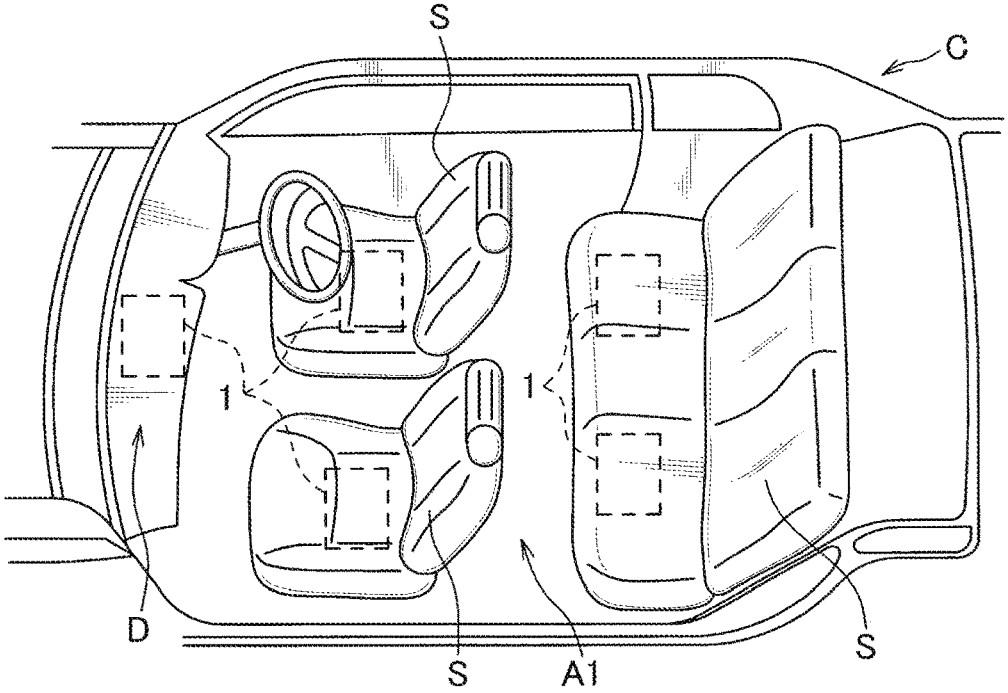
FIG. 2 is a perspective view illustrating a state where the acoustic conversion device for the active noise control is provided in a vehicle.
Figure 3:
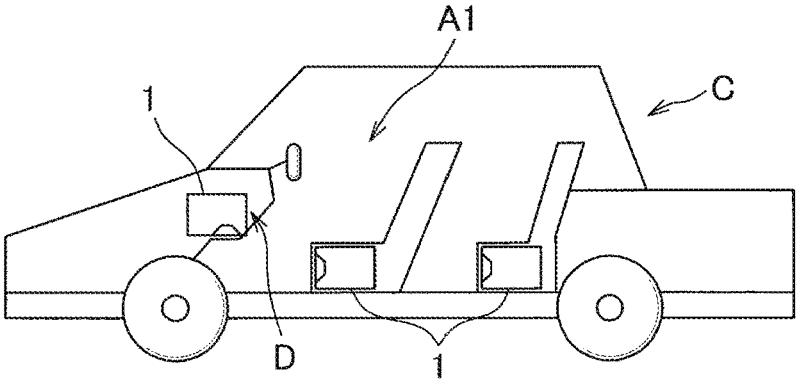
FIG. 3 is a side view illustrating the state where the acoustic conversion device for the active noise control is provided in the vehicle.
Figure 4:
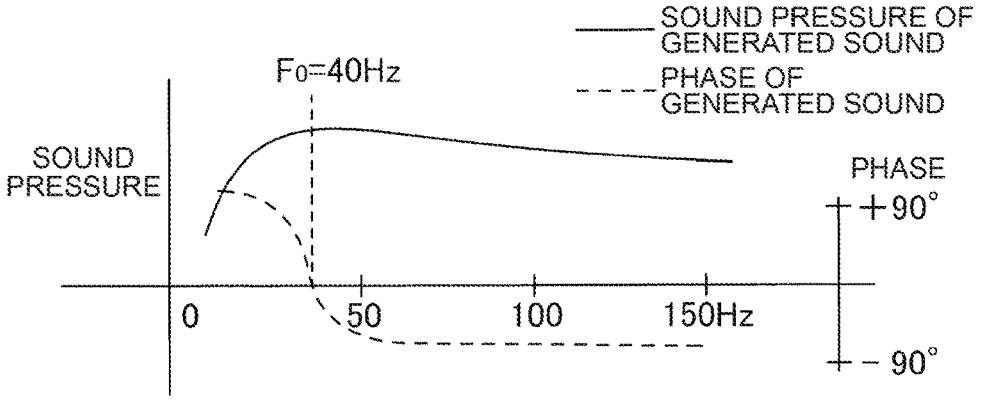
FIG. 4 is a graph showing frequency characteristics of sound emitted from the acoustic conversion device for the active noise control.

FIG. 1 is a schematic diagram illustrating acoustic conversion devices 1 for an active noise control according to Example 1 of the present invention. FIGS. 2 and 3 are respectively a perspective view and a side view illustrating a state where the acoustic conversion devices 1 for the active noise control are provided in a vehicle C. FIG. 4 is a graph showing frequency characteristics of sound emitted from the acoustic conversion device 1 for the active noise control.

Each of the acoustic conversion devices 1 for the active noise control includes a speaker unit 2 which emit sound, and an enclosure 3 as closed space-forming unit to which the speaker units 2 are mounted, i.e., the speaker units 2 are accommodated in the enclosure 3. The speaker units 2 are controlled by control means provided in the vehicle C.

Each of the speaker units 2 includes a vibration plate (not illustrated), an edge (not illustrated) for supporting the vibration plate, a magnetic circuit (not illustrated) capable of driving the vibration plate, a frame (not illustrated) for supporting the edge and the magnetic circuit, and a damper (not illustrated) for suppressing natural vibration, and a surface of the vibration plate emits sound to room space A1 for the active noise control of the vehicle C. Although it is not illustrated in the drawing, a back surface of the vibration plate may emit sound to the room space A1. The effective vibration diameter of the vibration plate is set to 12 cm for example.

In such speaker units 2, if the lowest resonance frequency of the vibration plate is defined as Fs and equivalent compliance air volume of the vibration plate is defined as $M_{ms}$, compliance $C_{ms}$ is calculated by the following equation (1).

$$C_{ms} = \frac{1}{4\pi^2 F_s^2 M_{ms}} \tag{1}$$

If air density is defined as ρ and sound speed is defined as c and actual vibration area (area of actually vibrating portion) of the vibration plate is defined as Sd, equivalent compliance air volume $V_{as}$ is calculated by the following equation (2).

$$Vas=\rho c^2 S_d^2 C_{ms} \tag{2}$$

The equivalent compliance air volume $V_{as}$ means a volume of the closed space behind the vibration plate when a resilient value of the vibration plate of the speaker units becomes equal to a resilient value of rear air of the vibration plate. That is, if a closed space which is smaller than equivalent compliance air volume $V_{as}$ is formed behind the vibration plate, the vibration plate is less prone to vibrate (suspension becomes hard) and low frequency sound becomes small, and if a closed space which is larger than equivalent compliance air volume $V_{as}$ is formed, the vibration plate is prone to vibrate (suspension becomes soft) and low frequency sound becomes large.

In the enclosure 3, the hermetical closed space A2 is formed on the side of the back surface of the vibration plate of the speaker unit 2, and the volume $V_{A2}$ of the closed space A2 is formed smaller than the equivalent compliance air volume $V_{as}$. The volume $V_{A2}$ of the closed space A2 is 55% of the equivalent compliance air volume $V_{as}$, for example, and the volume $V_{As}$ is 6 liters.

According to the acoustic conversion device 1 for the active noise control as described above, the lowest resonance frequency $F_0$ (substantially equal to lowest resonance frequency $F_S$ of vibration plate) is 40 Hz for example, and sound pressure emitted by the acoustic conversion device 1 for the active noise control has frequency characteristics as shown by a solid line in FIG. 4. When the acoustic conversion device 1 for the active noise control is not controlled by the control means, emitted sound is defined as generated sound, and phase of the generated sound has frequency characteristics shown by a broken line in FIG. 4.

Frequency dependence property of phase of generated sound is previously stored on storing means provided in the vehicle C, the control means controls the phase based on this, and the acoustic conversion device 1 for the active noise control emits into the room space A1, negating sound having opposite phase to noise. In phase of generated sound, inclination is large in the vicinity of lowest resonance frequency $F_0$ as shown in FIG. 4. In the acoustic conversion device 1 for the active noise control, it is possible to control phase of sound at frequency (frequency whose inclination of phase is not large) which is mainly greater than lowest resonance frequency $F_0$. If the lowest resonance frequency $F_0$ is varied, variation in phase with respect to small variation in frequency becomes large, and it becomes difficult to appropriately control the phase. Hence, in the acoustic conversion device 1 for the active noise control, even if the speaker unit is deteriorated with time, it is necessary to constantly maintain the lowest resonance frequency $F_0$ which is output.

Control of phase performed by control means will be described below specifically. For example, when generated sound of the acoustic conversion device 1 for the active noise control which is not deteriorated lags behind the opposite phase of noise by 45° at 45 Hz, the control means previously controls to move the phase ahead by 45° and emits the negating sound. Here, if the lowest resonance frequency $F_0$ is varied toward a smaller side and the delay of the phase at 45 Hz is largely varied from 45°, it becomes difficult for the control means to appropriately control the phase. In this case, the negating sound is deviated from the opposite phase of noise, the noise cannot be suppressed or a user listens to sound which is stronger than the original noise in some cases.

In contrast, according to the acoustic conversion device 1 for the active noise control of this embodiment, volume $V_{A2}$ of the closed space A2 is smaller than the equivalent compliance air volume $V_{as}$. Therefore, since the enclosure 3 is provided, motion of the vibration plate, the edge and the damper is suppressed, and it is possible to suppress deterioration with time of the edge and the damper. Thus, variation in the lowest resonance frequency $F_0$ can be suppressed.

By the above-described configuration, when the control means controls phase based on frequency dependence property of phase of generated sound which is previously stored, phase of generated sound is less prone to be deviated from the opposite phase of noise, and it is possible to effectively suppress or remove the noise.

Further, since volume $V_{A2}$ of the closed space A2 is 55% of the equivalent compliance air volume $V_{as}$, it is possible to restrain the vibration plate, the edge and the damper from being deteriorated, and it is possible to prevent low frequency sound from becomes excessively small.

Since the lowest resonance frequency $F_0$ is 40 Hz, it is possible to effectively suppress or remove low frequency sound noise included in engine sound.

Further, since the effective vibration diameter of the vibration plate is 12 cm and the volume $V_{A2}$ of the closed space A2 is 6 liters, a size of the entire acoustic conversion device 1 for the active noise control can be made small, and the acoustic conversion device 1 for the active noise control can be placed in the vicinity of a passenger utilizing an appropriate space in the vehicle C.

Next, installation positions of the acoustic conversion devices 1 for the active noise control in the vehicle, and shapes of the acoustic conversion devices 1 will be described. As illustrated in FIGS. 2 and 3, the acoustic conversion devices 1 for the active noise control are provided under seats S and in a dashboard D, and the acoustic conversion devices 1 for the active noise control are formed into rectangular parallelepiped shapes so that they can be placed in such positions.

Due to the above configuration, the acoustic conversion devices 1 for the active noise control can be placed while effectively utilizing the room space A1 for the vehicle C.

Example 2

Figure 5:
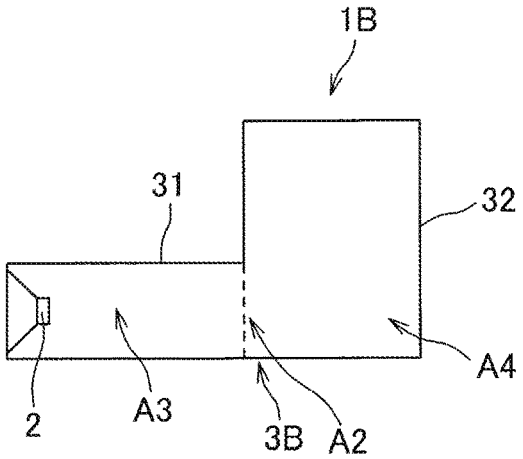
FIG. 5 is a schematic diagram illustrating an acoustic conversion device for an active noise control according to Example 2.

As illustrated in FIG. 5, in an acoustic conversion device 1B for the active noise control of Example 2, an enclosure 3B includes a first member 31 forming a first closed space A3 in which speaker units 2 are accommodated, and a second member 32 forming a second closed space A4 which is in communication with the first closed space A3.

The speaker units 2 emit sound to the rear first closed space A3, and this sound is further emitted to the second closed space A4. Therefore, the first closed space A3 and the second closed space A4 configure a closed space A2. A volume $V_{A2}$ of the closed space A2 is formed smaller than an equivalent compliance air volume $V_{as}$ like Example 1.

Figure 6:
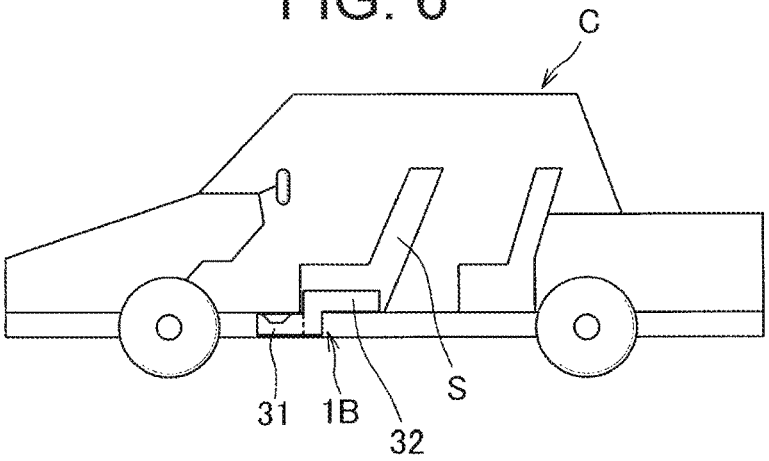
FIG. 6 is a side view illustrating a state the state where the acoustic conversion device for the active noise control is provided in a vehicle.
Figure 7:
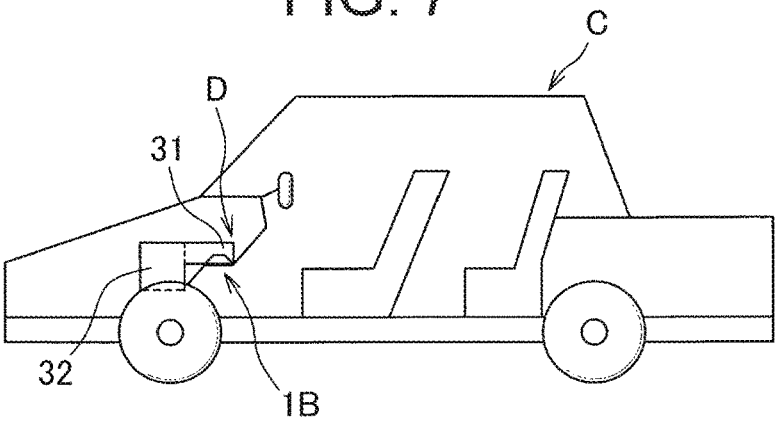
FIG. 7 is a side view illustrating the state where the acoustic conversion device for the active noise control is provided in the vehicle.

According to the above-described acoustic conversion device 1 for the active noise control, the first member 31 is provided in the vicinity of a passenger, and the second member 32 is placed at a position where an installation space can easily be secured in the vehicle C. As illustrated in FIG. 6 for example, the first member 31 may be provided under foot and the second member 32 may be provided below a seat S. Alternatively, the first member 31 may be provided in a dashboard D and the second member 32 may be provided on a floor forwardly separated from a passenger as illustrated in FIG. 7.

Due to this configuration, it is possible to suppress variation in lowest resonance frequency $F_0$ and it is possible to effectively suppress or remove noise like Example 1.

Further, if the first member 31 is provided in the vicinity of a passenger, noise which the passenger feels can effectively be suppressed or removed, and if the second member 32 is provided at an appropriate position in the vehicle C, it is possible to secure the volume $V_{A2}$ of the closed space A2.

Figure 8:
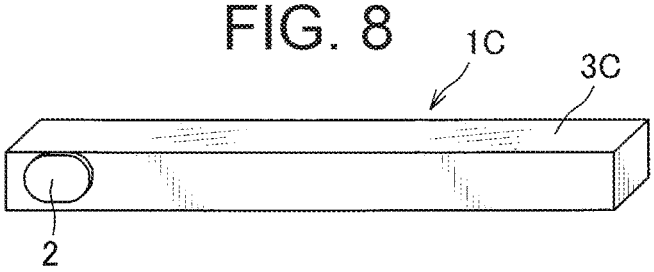
FIG. 8 is a schematic diagram illustrating an acoustic conversion device for an active noise control according to a modification.

The present invention is not limited to Examples 1 and 2, other configurations capable of achieving the object of the invention are included in the invention, and the following modifications are also included in the invention. For example, although the acoustic conversion devices 1 for the active noise control are formed into the rectangular parallelepiped shapes in Example 1 so that the acoustic conversion device 1 for the active noise control can be placed under the seat S or in the dashboard D for example, the acoustic conversion device 1 for the active noise control may have appropriate shapes in accordance with installation place. When the acoustic conversion device 1 for the active noise control is provided in a space extending in the longitudinal direction of the vehicle, an acoustic conversion device 1C for the active noise control may have an enclosure 3C extending in a predetermined longitudinal direction as illustrated in FIG. 8.

Figure 9:
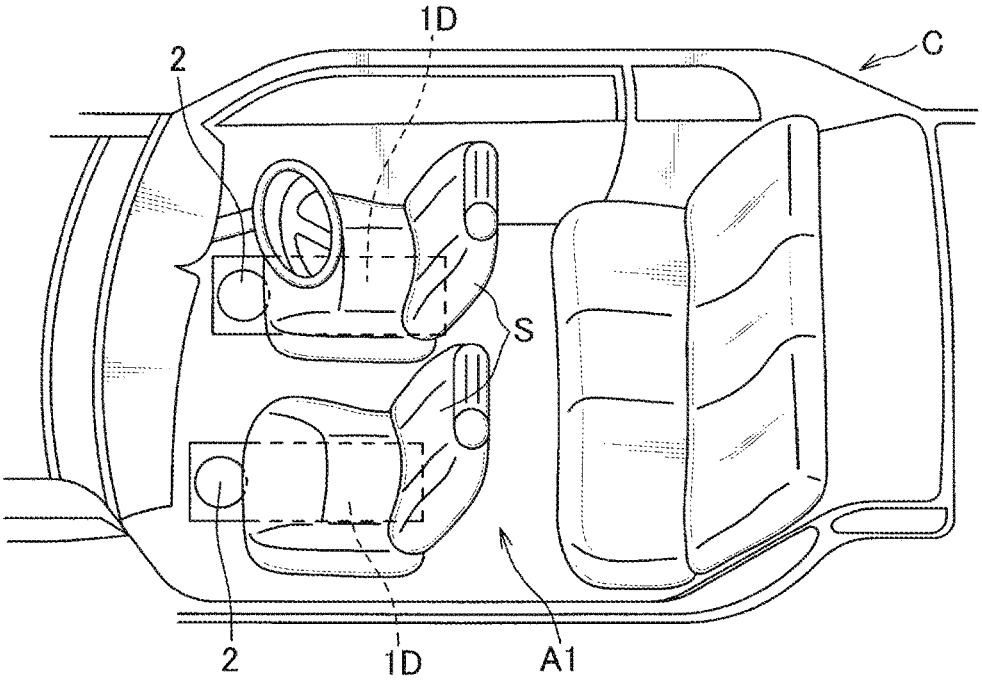
FIG. 9 is a perspective view illustrating a state where an acoustic conversion device for an active noise control according to another modification is provided in a vehicle.
Figure 10:
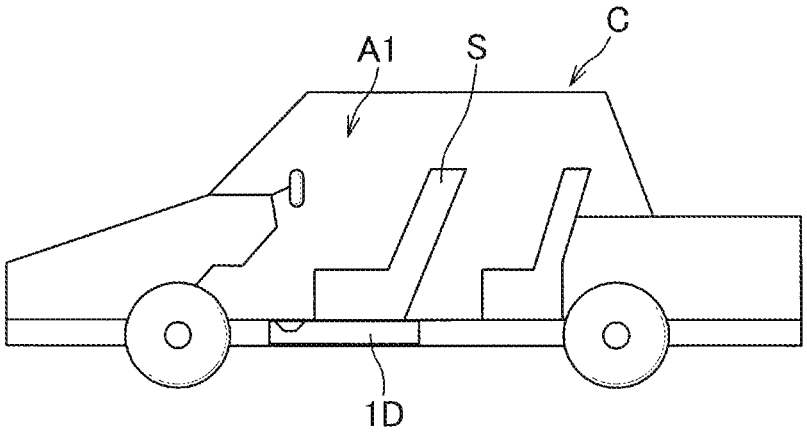
FIG. 10 is a side view illustrating the state where the acoustic conversion device for the active noise control is provided in the vehicle.

Although the acoustic conversion devices 1, 1B for the active noise control are provided under the seat S or in the dashboard D in Examples 1 and 2, an acoustic conversion device 1D for the active noise control may be provided under a floor of the vehicle C, and the speaker units 2 may emit sound toward foot of a passenger, for example, as illustrated in FIGS. 9 and 10. According to this configuration, a space under a floor can effectively be utilized, and by emitting sound in the vicinity of a passenger, it is possible to effectively suppress or remove noise.

Although engine sound is selected as noise in Example 1, noise such as wind noise and tire friction sound may be suppressed or removed. Noise patterns corresponding to vehicle states such as vehicle type, speed and acceleration may previously be stored, generated noise may be detected and negating sound in accordance with noise may be emitted.

The volume of the closed space, the lowest resonance frequency, and the effective vibration diameter may be set to appropriate values only if the volume of the closed space is smaller than the equivalent compliance air volume.

It is necessary that the speaker unit includes the vibration plate and the edge, other shape and type thereof are not especially limited, and it is necessary that sound can be generated under appropriate sound pressure in frequency in accordance with noise.

Although the best configuration and method for carrying out the present invention have been described above, the invention is not limited to them. That is, the invention is illustrated and described concerning the specific embodiment, but a person skilled in the art can variously modify the above-described embodiment in terms of shapes, materials, the numbers and other detailed configurations. Therefore, the descriptions to limit the above-disclosed shapes and materials are described to make it easy to understand the present invention, and they do not limit the invention. Thus, descriptions of names of members from which a portion or all of the limitations such as the shapes and the materials are removed are included in the invention.

REFERENCE SIGNS LIST

1 acoustic conversion device for the active noise control
2 speaker unit
3 enclosure (closed space-forming unit)
31 first member
32 second member
A1 room space
A2 closed space
A3 first closed space
A4 second closed space
C vehicle
S seat
D dashboard

The invention claimed is:

1. An acoustic conversion device for an active noise control comprising:

a speaker unit for emitting sound; and an enclosure for accommodating the speaker unit and forming a closed space to which at least a part of the sound is emitted, wherein a volume of the closed space is smaller than an equivalent compliance air volume of the speaker unit, wherein the speaker unit includes a vibration plate, and wherein an effective vibration diameter of the vibration plate is 10 cm or more and 14 cm or less, and the volume of the closed space is 5 liters or more and 7 liters or less.

2. The acoustic conversion device for the active noise control according to claim 1, wherein the volume of the closed space is 40% or more and 80% or less of the equivalent compliance air volume.

3. The acoustic conversion device for the active noise control according to claim 1, wherein the enclosure is provided in a dashboard of a vehicle.

4. The acoustic conversion device for the active noise control according to claim 1, wherein a lowest resonance frequency in a state where the speaker unit and the enclosure are assembled together is 30 Hz or more and 50 Hz or less.

5. The acoustic conversion device for the active noise control according to claim 1, wherein the enclosure is provided below a seat of the vehicle.

6. The acoustic conversion device for the active noise control according to claim 1, wherein the enclosure is provided under a floor of the vehicle.

7. The acoustic conversion device for the active noise control according to claim 1, wherein the enclosure includes a first member forming a first closed space in which the speaker unit is accommodated, and a second member forming a second closed space which is in communication with the first closed space, and wherein sound emitted from the speaker unit to the first closed space is emitted to the second closed space.

8. The acoustic conversion device for the active noise control according to claim 1, wherein the enclosure includes a first member forming a first closed space in which the speaker unit is accommodated, and a second member forming a second closed space which is in communication with the first closed space, and wherein the volume of the closed space is a total of a volume of the first closed space and a volume of the second closed space.

* * * * *